US006300730B1

(12) United States Patent
Perreaut et al.

(10) Patent No.: US 6,300,730 B1
(45) Date of Patent: Oct. 9, 2001

(54) ELECTRON BEAM DEFLECTION SYSTEM FOR CATHODE RAY TUBES

(75) Inventors: Jean-Marc Perreaut, Dijon; Bruno Roussel, Longchamp, both of (FR)

(73) Assignee: Thomson Tubes & Displays, S.A., Boulogne (FR)

( * ) Notice: Subject to any disclaimer, the term of this patent is extended or adjusted under 35 U.S.C. 154(b) by 0 days.

(21) Appl. No.: 09/284,381

(22) PCT Filed: Oct. 13, 1997

(86) PCT No.: PCT/IB97/01260

§ 371 Date: Apr. 12, 1999

§ 102(e) Date: Apr. 12, 1999

(87) PCT Pub. No.: WO98/16945

PCT Pub. Date: Apr. 23, 1998

(30) Foreign Application Priority Data

Oct. 15, 1996 (FR) ..... 96 12534

(51) Int. Cl.[7] ..... G09G 1/28
(52) U.S. Cl. ..... 315/368.28; 315/370; 313/421
(58) Field of Search ..... 315/370, 368.25, 315/368.28; 313/413, 421, 440

(56) References Cited

U.S. PATENT DOCUMENTS 4,714,908 * 12/1987 Watabe et al. ..... 335/212
4,725,763 2/1988 Okuyama et al. ..... 315/368
4,972,519 * 11/1990 Grote ..... 313/440
5,248,920 9/1993 Gioia et al. ..... 315/368
5,306,982 * 4/1994 Maillot et al. ..... 313/413

FOREIGN PATENT DOCUMENTS 0193983 9/1986 (EP) ..... H01J/29/56
0250027 12/1987 (EP) ..... H01J/29/56
0562200 9/1993 (EP) ..... H01J/29/56
4-056047 2/1992 (JP) ..... H01J/29/76

OTHER PUBLICATIONS

*Patent Abstracts of Japan, vol. 016, No. 254, Jun. 9, 1992, & JP 04–056047.

* cited by examiner

*Primary Examiner*—Don Wong
*Assistant Examiner*—Thuy Vinh Tran
(74) *Attorney, Agent, or Firm*—Joseph S. Tripoli; Joseph J. Laks; Daniel E. Sragow

(57) ABSTRACT

The coils of an astigmatism corrector for an electron beam of a cathode ray tube are positioned on a flexible support. The support is disposed around the neck of the tube and positioned at least partially adjacent the back part of at least one pair of deflection coils, so as to reduce interaction of the fields produced by the astigmatism corrector with the elements of the electron gun.

10 Claims, 6 Drawing Sheets

ELECTRON BEAM DEFLECTION SYSTEM FOR CATHODE RAY TUBES

FIELD OF THE INVENTION

The invention relates to a device intended to correct the astigmatic deflection field effect on the focussing of the electron beam generated by the electron gun of a cathode ray tube and on the beam deflection system incorporating such a device.

BACKGROUND OF THE INVENTION

In a cathode ray tube, the deflection device, also called a deflector, has as its purpose deflecting the electron beam coming from the electron gun so as to make it scan the whole surface of the tube screen and to generate the desired pictures on it.

It is known that in the case where the screen surface is not spherical, or where the radius of a spherical screen is substantially greater than the distance from the center of deflection to the screen, a uniform deflection field generates picture geometry defects which are more substantial as the surface of said screen is flatter. To correct, wholly or in part, these geometry defects, it is likewise known to change the frame and line deflection field of the deflector in order to make them astigmatic.

However, astigmatic deflection fields have the effect of acting on the focussing of the electron beam in such a way that the point of impact on the screen, also called spot, is not circular but undergoes distortions (lengthening along one direction, luminous halo around the central spot, etc.).

These distortions are particularly disturbing to the image definition and need to be corrected for all applications where a high resolution is required.

The astigmatism correction devices of the state of the art comprise pairs of coils which can be wound around rings of ferromagnetic material and disposed at the back of the deflector, partially or wholly around the electron gun.

These devices experience a new limitation due to the higher frequencies of scanning applied to the deflectors, which frequencies may be greater than 64 kHz. Actually, if the astigmatism correction device is disposed at the back of the deflector, around metal parts of the electron gun, these parts act, at high frequency, like an obstacle relative to the magnetic field generated by the correction device. This has the effect of introducing a delay in the establishment of the magnetic correction field, manifesting itself on the screen as a phase error rendering said correction insufficient.

A solution to the problem resides in lengthening the neck of the tube so that the astigmatism correction device is not above the electron gun. This solution is not viable because the market requires a display whose depth is reduced.

SUMMARY OF THE INVENTION

A solution to the problem resides in lengthening the neck of the tube so that the astigmatism correction device is not above the electron gun. This solution is not viable because the market requires a display whose depth is reduced.

In order to provide a solution to these problems, the deflection system according to the invention comprises:

a deflection comprised of a pair of horizontal deflection coils molded in the shape of a saddle, a pair of vertical deflection coils, at least one of these pairs creating an astigmatic deflection field, a separator located between the two pairs of deflection coils, a core of ferromagnetic material concentrating the fields created by the deflection coils;

an astigmatic deflection field astigmatism corrector comprising several coils of radial axis disposed around the neck of the tube so as to generate magnetic fields acting on the shape of the electron beam;

characterized in that the astigmatism corrector is disposed around the neck of the tube at least partially adjacent the back part of at least one pair of deflection coils.

BRIEF DESCRIPTION OF THE DRAWING

Other characteristics and advantages of the invention will appear with the aid of the description and the drawings below, among which.

DETAILED DESCRIPTION

Under the action of uniform vertical and horizontal deflection magnetic fields the volume swept by the beam coming from the electron gun of a cathode ray tube is defined by a pyramidal surface, which surface has as its summit the deflection center O of the deflector.

Figure 1A:
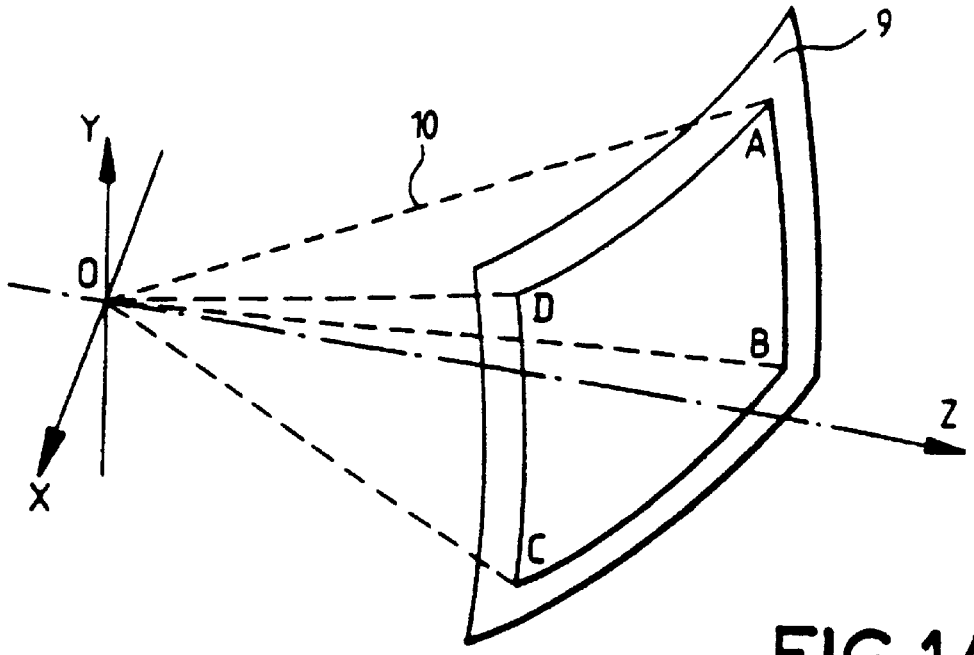
FIGS. 1A and 1B compare the effect of sweeping a front surface of a cathode ray tube by a beam of electrons in the case where said front surface is spherical relative to the case where said front surface is essentially flat, in order to reveal the geometry defects to be corrected.

FIG. 1A shows the intersection of the pyramidal surface 10 of summit O generated by an electron beam under the action of vertical and horizontal deflection fields with the front surface or screen 9 of the cathode ray tube, which front surface has a spherical surface whose center coincides with the deflection center O. In this case, the field created by the vertical and horizontal deflection fields are uniform.

The intersection defines in this case a curvilinear rectangle ABCD.

Figure 1B:
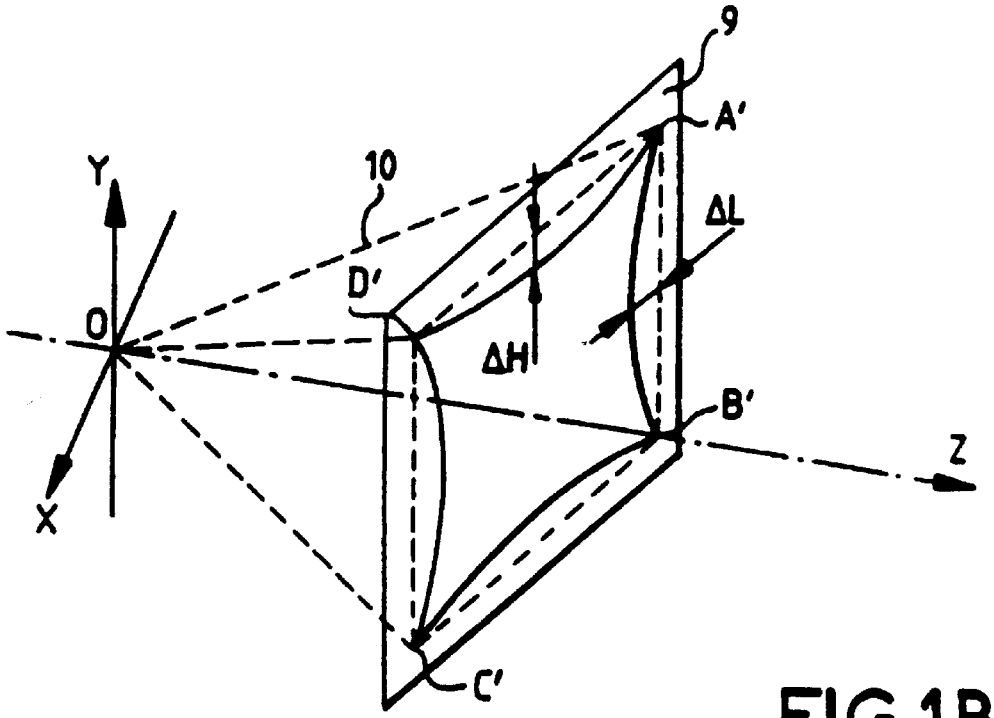

FIG. 1B shows the intersection of the same pyramidal surface under the same conditions with a front surface 9 which is essentially flat. This intersection defines a FIG. A'B'C'D' defined by two crossed hyperbolas generating from this fact in comparison with the ideal figure ABCD, a defect of geometry called "pillow" or "pincushion", whose maximum amplitude is represented by $\Delta H$ along the vertical Y axis and by $\Delta L$ along the horizontal X axis, H and L being respectively the height and width of the visible screen.

The use of astigmatic or non-uniform deflection fields makes it possible to compensate the effect of flatness of the front surface or of the screen on which the picture is to be formed. These non-uniform fields will, however, modify the focussing of the beam, which focussing is operated on the level of terminal stages of the electron gun. Modification of the focussing results in widening of the spot on the screen along a biased direction and/or deconcentration of the beam causing the spot to appear with a halo.

Figure 2:
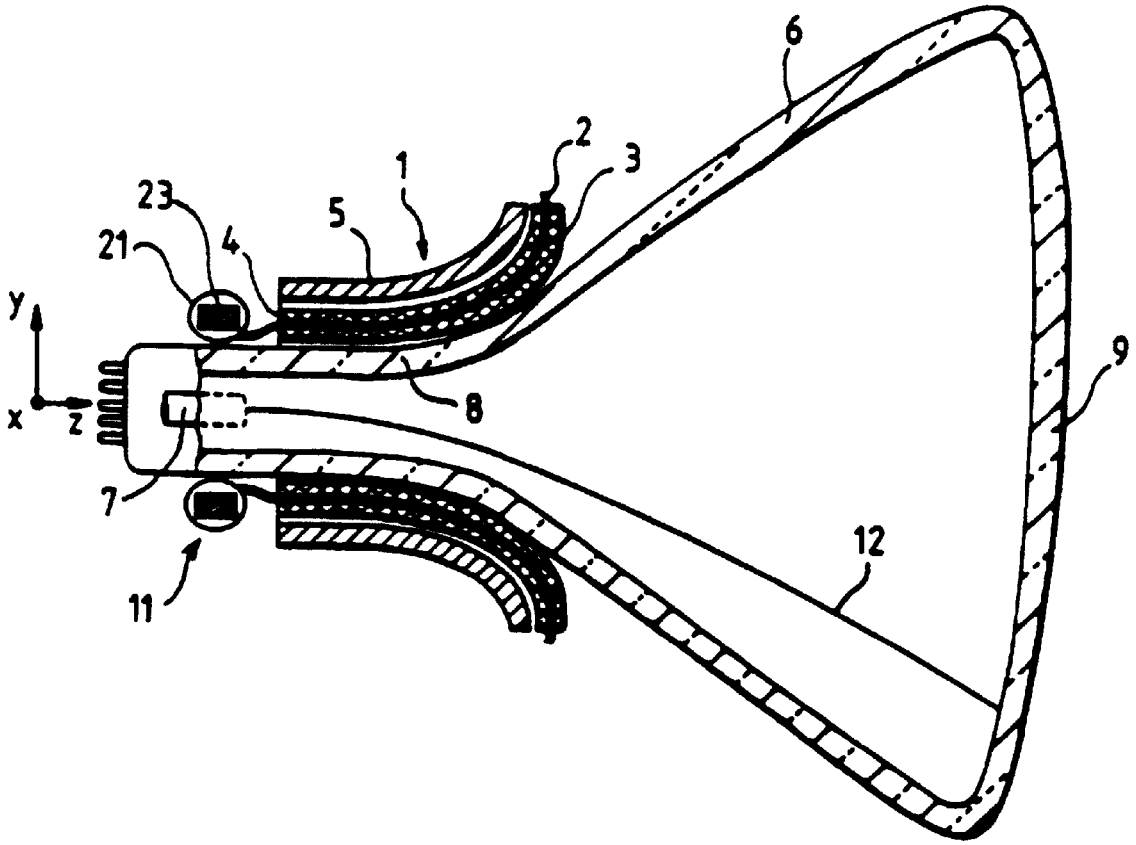
FIG. 2 is a schematic representation of a cathode ray tube equipped with an electromagnetic deflection device and an astigmatism corrector according to the state of the art.

In FIG. 2 there is represented schematically the cross section of a tube 6 with a longitudinal axis Z equipped with its deflector 1 along the plane of vertical symmetry.

Figure 3:
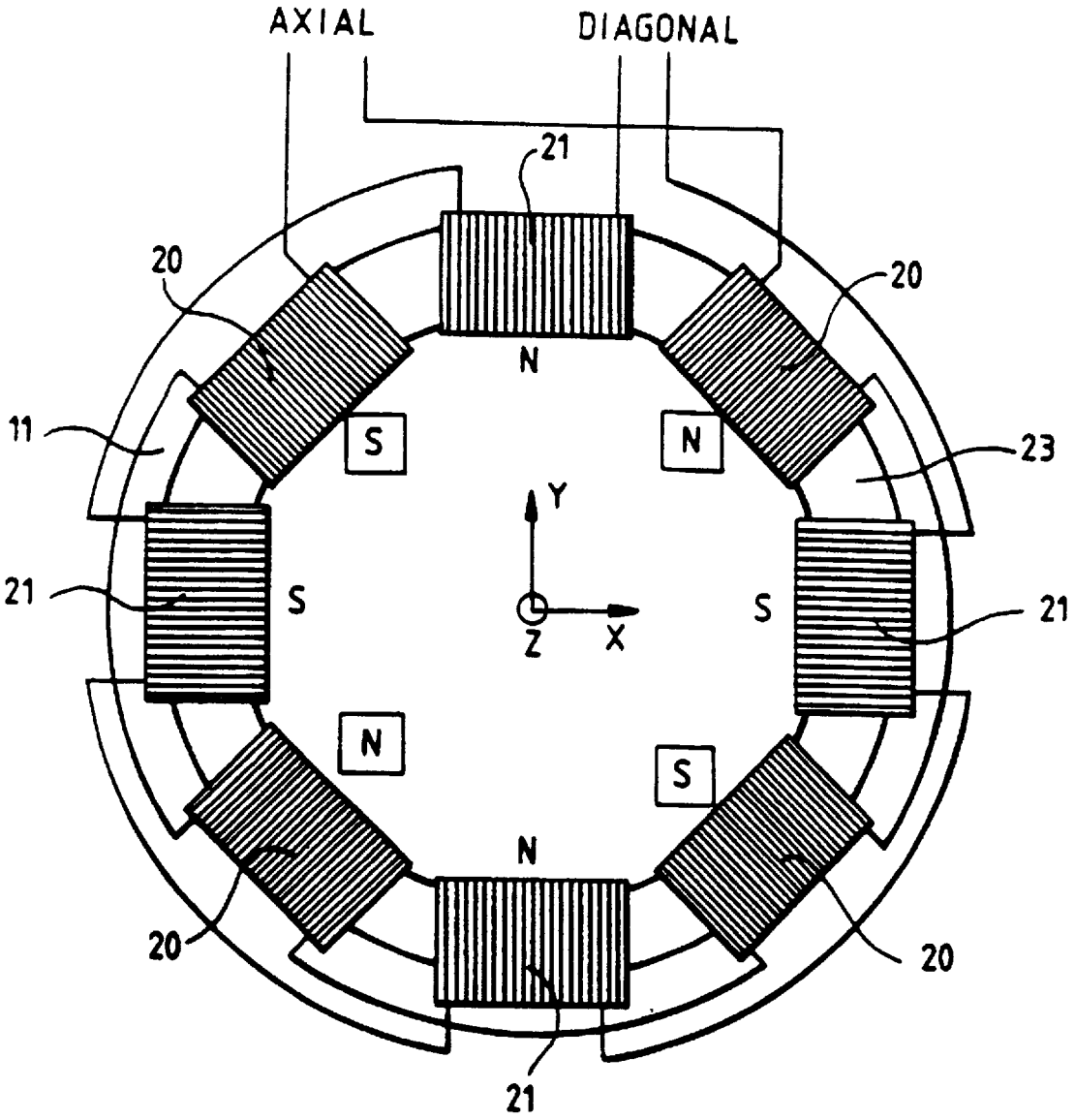
FIG. 3 is a frontal view of an example of implementation of an astigmatism corrector according to the state of the art.

The deflection 1 is of a known type and has a pair of vertical deflection coils 4 and a pair of horizontal deflection coils 3, at least one pair of coils generating an astigmatic deflection magnetic field. The pairs of coils are electrically insulated by a separator 2, generally of rigid plastic It is known, as shown in FIGS. 2 and 3, to use sets of coils forming a quadrupole to correct the effect of astigmatism of the deflection fields. Each magnetic quadrupole may correct the astigmatism of the field in one direction; to correct the effects at all points of the screen it is thus necessary to be able to make a correction along the X and Y axes as well as along the diagonals or bisectors of the angles formed by these axes.

Figure 4A:
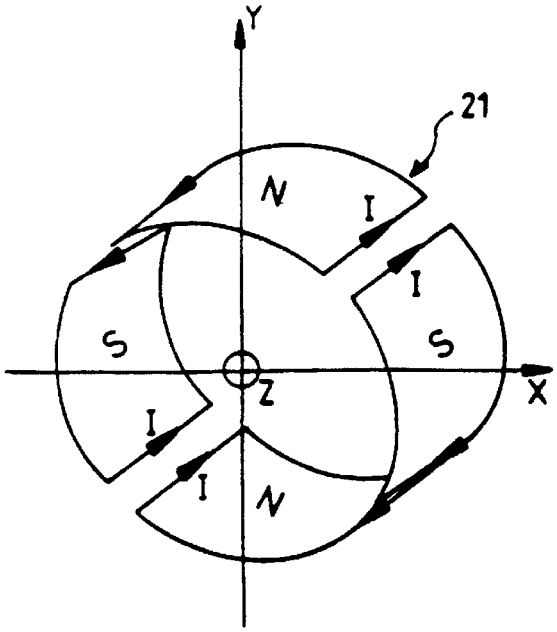
FIGS. 4A, 4A', 4B, 4B' show the effects of electromagnetic quadrupoles on the shape of the electron beam.
Figure 4A:
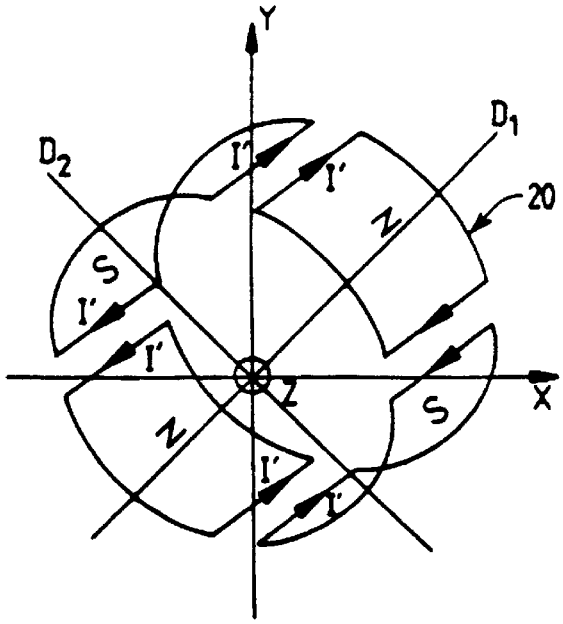
Figure 4B:
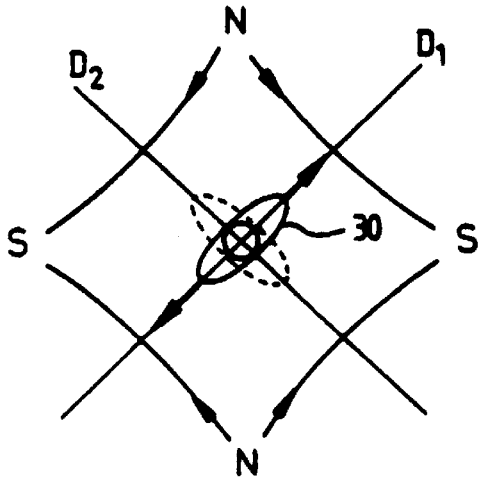
Figure 4B:
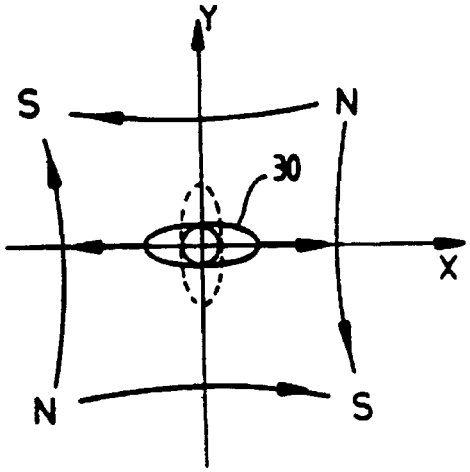

These coils, forming magnetic quadrupoles, are disposed around the neck of the tube. At least two sets of coils 20 and 21 are necessary: one set of four coils 20 forming successively north and south poles, to correct the effects of astigmatism along the X and Y axes and a set of four coils 21 forming likewise successively north and south poles to correct the effects of astigmatism along the diagonals, the poles of the coils of the two sets being shifted 45 degrees from each other. FIGS. 4A, 4A', 4B and 4B' show the effect of the quadrupoles 20 and 21 on the section 30 of the electron beam. According to the polarity of the currents 1 and 1' circulating respectively in the coils 21 and 20, the beam may be deformed and lengthened in the X or Y direction by the coils 20 and in the direction of the diagonals D1 or D2 by the coils 21, to compensate the undesirable effects due to the astigmatism of at least one of the magnetic fields of deflection, and this at every point of the tube's screen.

FIG. 3 illustrates a mode of implementation of a corrector according to the state of the art. The windings 20 and 21 of the corrector are formed around an essentially cylindrical ring of ferromagnetic material 23, the set of the four X axial astigmatism correction coils being shifted by 45 degrees relative to the set of the diagonal astigmatism correction coils.

The astigmatism corrector is then mounted on the neck of the tube behind the deflector as indicated in FIG. 2.

The currents feeding the astigmatism corrector coils are generally of the same frequency as the scanning signals applied to the horizontal deflection coils. In a conventional manner the current feeding the coils intended to correct the axial astigmatism is the weighted sum of two parabolic currents having as a frequency, one the vertical sweep frequency, the other the horizontal sweep frequency. The current I is in a manner likewise known the result of the weighted product of two currents, one of sawtooth of frequency equal to the vertical sweep frequency, the other parabolic, of a frequency equal to the horizontal sweep frequency.

Up to a horizontal sweep frequency on the order of 64 kHz, it is possible to correct, by such a device, the spot form defects generated by the field astigmatism.

It has been noted that at higher horizontal sweep frequencies the correction becomes less and less effective as the correction signal frequency increases.

These problems are due to the metal grids of the electron guns which act as an obstacle to the magnetic fields coming from the astigmatism corrector. The effect of them is a delay in the establishment of said fields, which entails a phase error in the correction. The correction field seen at instant t by the electron beam is shifted by $\Delta t$ relative to the current circulating in a magnetic quadrupole, this delay $\Delta t$ increasing with the correction signal frequency.

High definition display devices using cathode ray tubes operate at sweep frequencies which may reach 200 kHz. At these frequency values, an astigmatism correction device according to the state of the art is not usable, all the more so since harmonics of 600 kHz frequency are present in the correction current. Moreover, even if it is possible to compensate the delay in the establishment of the correction field for a given horizontal sweep frequency, by means, for example, of electronic circuits, it becomes almost impossible and in any case very burdensome to use this type of compensation for display devices having high frequency horizontal sweep.

Figure 5:
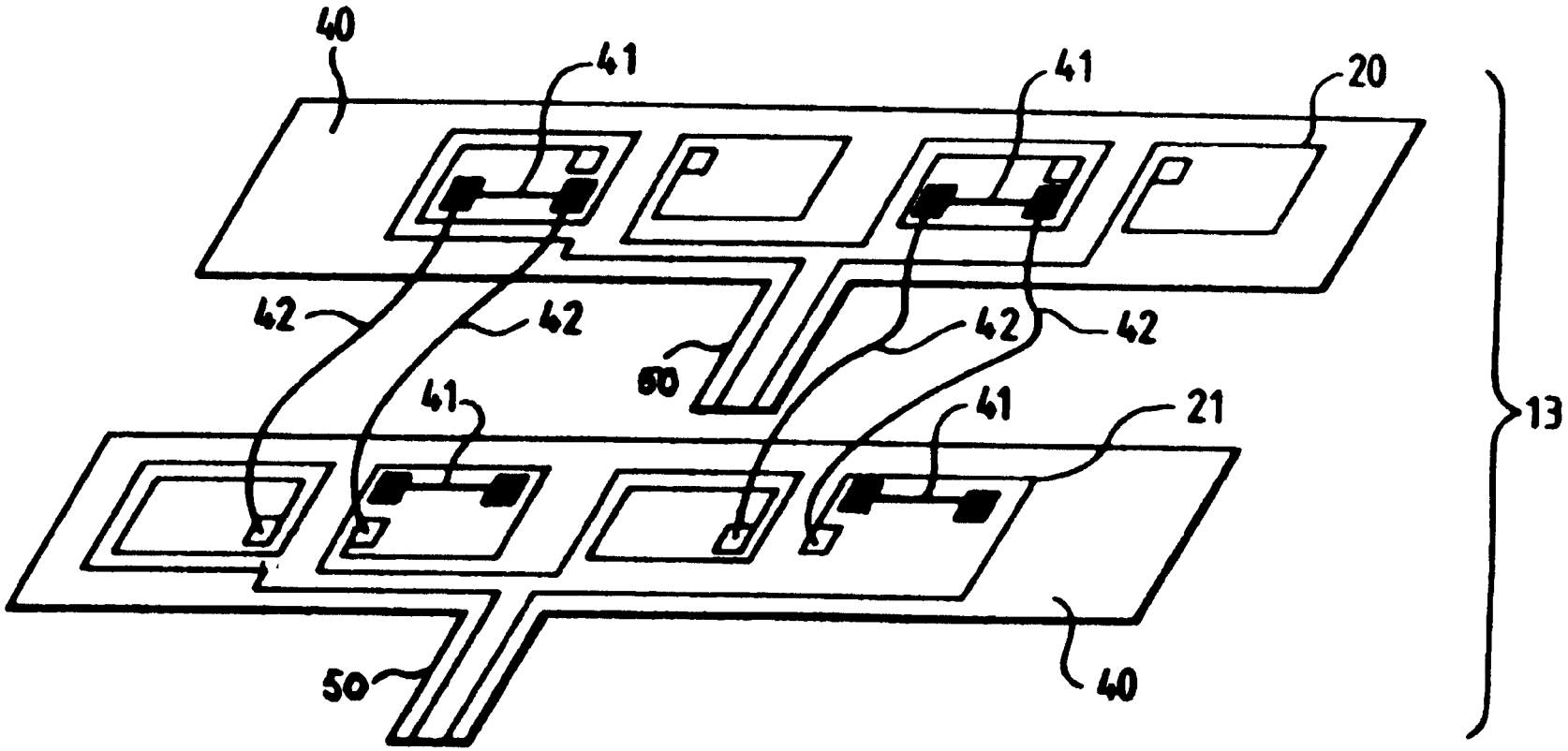
FIG. 5 is an illustration of a preferred mode of implementation of the invention.

In a preferred implementation of the invention, such as shown in FIG. 5, the two sets of coils 20 and 21 are formed by engraving a conductive layer on a flexible support 40. The engraving forms coils which are carried on the flat support, which is then wound around the neck of the tube to form the astigmatism corrector 13.

Each set of coils may be formed on different flexible supports or preferably on the same flexible support. In this latter case, the coils may be engraved on a single surface or on both surfaces of the flexible support 40. The size of the device is minimized by engraving certain coils, for example a set of coils forming a quadrupole, on one support surface and engraving the other coils of the corrector, for example of the other set of coils forming the quadrupole, on the opposite surface. This arrangement offers the additional advantage of not having to position one of the coil sets relative to the other.

The implementation of the invention illustrated by FIG. 5 shows the engraving of one set of coils forming a magnetic quadrupole on one of the support surfaces of insulating material 40, and the engraving of the other set of coils forming a magnetic quadrupole between the coils of a given set, connections made on the side opposite the side on which the coils of said set are engraved. The electrical continuity is then ensured by connections traversing the wall of the flexible support 40, for example the connections 42 for the coils 21, which connections are for example in the form of metallized holes.

The support 40 comprises moreover a transverse tab 50 permitting the connection of the coils 20 and 21 to their respective power supply.

Figure 6:
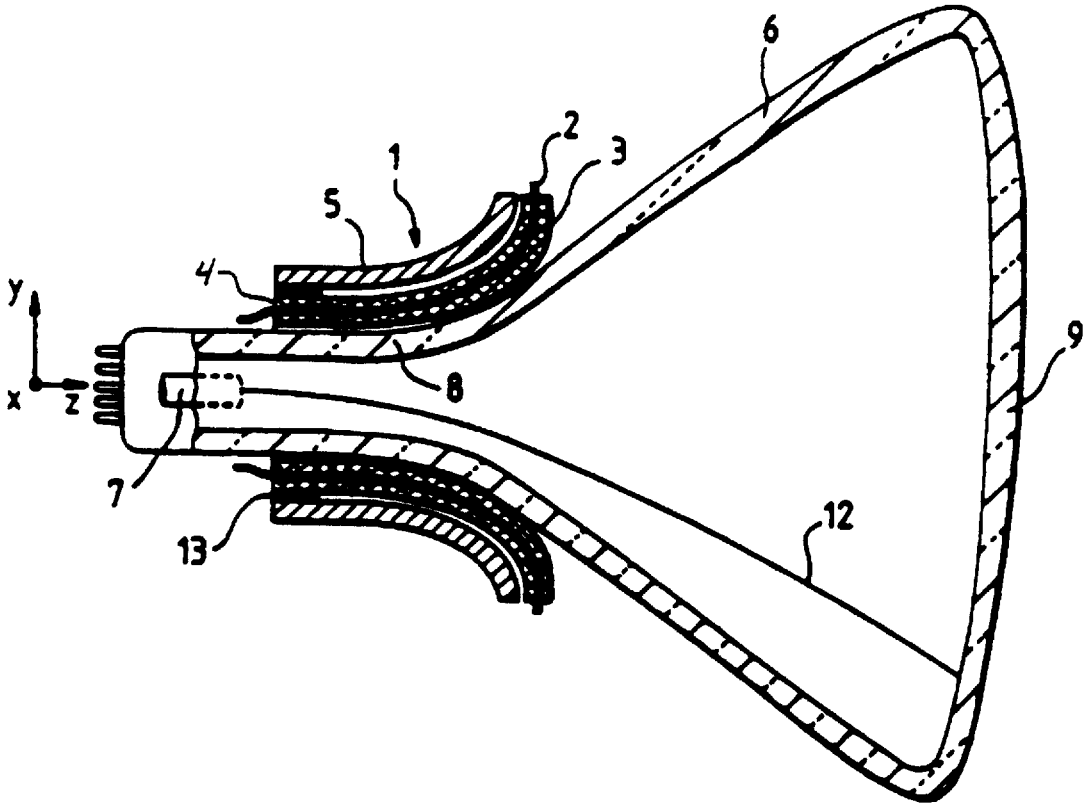
FIG. 6 represents a cutaway view of an electromagnetic deflection system according to a mode of implementation of the invention.

Once the coils are engraved, the flexible support, in view of its very small volumetric size, may be rolled up and inserted under the back part of the deflector 1 or directly on the neck of the tube, or on the separator 2, or even on the back part of the vertical deflection coils between these coils, and the ring core of ferromagnetic material 5 as illustrated by FIG. 6. This latter arrangement offers a double advantage:

it guarantees the best sensitivity of the astigmatism corrector, i.e. the maximum effect on the electronic beam for a given correction current, from the fact of its proximity with the ring of ferromagnetic material concentrating the field created by a set of coils 20 or 21;

it permits the corrector to be sufficiently removed from the horizontal deflection coils to avoid creating interference between these coils to which are applied the high tension peaks, on the order of a thousand volts during the horizontal or line return, and the astigmatism fed under low tension.

The foregoing example is not limiting. In another mode of implementation not shown, the astigmatism correction is carried out with the aid of two sets of flat coils made of insulated wires, the two sets being arranged one over the other so that the axes of the coils are shifted from one set to the other by 45 degrees. A cylindrical support which is then, flexible or rigid, may be mounted between the two sets of coils so as to form with the correction coils a mechanical unit, the coils being able to be positioned and fixed on the support, for example, by means of glue.

What is claimed is:

1. A beam deflection system for cathode ray tube, comprising:

a deflector having a pair of saddle-shaped horizontal deflection coils and a pair of vertical deflection coils, at least one of these pairs creating an astigmatic deflection field, a separator insulating the two pairs of deflection coils from each other, a ring core of ferromagnetic material concentrating the fields created by the deflection coils, a deflection field astigmatism corrector comprising a plurality of radial axis coils disposed around a neck of the tube to generate magnetic fields acting on the shape of an electron beam, wherein the astigmatism corrector is disposed around the neck of said tube axially overlapping the back part of at least one pair of deflection coils.

2. A deflection system according to claim 1, wherein the astigmatism corrector is at least partially disposed axially overlapping the back part of the ring core of ferromagnetic material.

3. A deflection system according to claim 2, wherein the astigmatism corrector is disposed between the back part of the ring core of ferromagnetic material and the back part of the vertical deflection coils.

4. A deflection system according to claim 1, wherein the astigmatism corrector comprises two sets of coils forming a magnetic quadrupole.

5. A deflection system according to claim 4, wherein the axes of the coils of the two sets are shifted radially by about 45 degrees.

6. A deflection system according to claim 4, wherein the coils of a given set are positioned on the same side of the flexible support.

7. A deflection system according to claim 6, wherein electrical connections between the coils of a given set are positioned on the side of the support opposite to that on which the coils of said set are positioned.

8. A deflection system according to claim 1, wherein the astigmatism corrector coils are positioned on a flexible support.

9. A deflection system according to claim 8, wherein the astigmatism corrector coils are positioned on both sides of the same flexible support.

10. A deflection system according to claim 1, wherein the frequency of the signal applied to the horizontal deflection coils is greater than 64 kHz.

* * * * *